US008038140B2

(12) United States Patent
Kimura et al.

(10) Patent No.: US 8,038,140 B2
(45) Date of Patent: Oct. 18, 2011

(54) DOCUMENT FEEDING DEVICE, IMAGE FORMING APPARATUS INCLUDING SAME, AND CONTROL METHOD FOR THE DOCUMENT FEEDING DEVICE

(75) Inventors: Norio Kimura, Sagamihara (JP); Hideki Tobinaga, Tokyo (JP); Akira Hirose, Tokyo (JP); Shinya Kitaoka, Kawasaki (JP); Motoya Sano, Zama (JP); Atsushi Kanaya, Yokohama (JP); Michitaka Suzuki, Hadano (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/659,152

(22) Filed: Feb. 26, 2010

(65) Prior Publication Data

US 2010/0225045 A1 Sep. 9, 2010

(30) Foreign Application Priority Data

Mar. 4, 2009 (JP) ..... 2009-050523

(51) Int. Cl.
*B65H 5/00* (2006.01)

(52) U.S. Cl. ..... 271/10.03; 271/10.01; 271/10.09; 271/4.01; 271/4.03; 271/4.08

(58) Field of Classification Search ..... 271/4.01, 271/4.03, 4.08, 10.01, 10.03, 10.09
See application file for complete search history.

(56) References Cited

U.S. PATENT DOCUMENTS

| | | | | |
|---|---|---|---|---|
| 6,923,437 | B2 * | 8/2005 | Huang et al. | 271/4.03 |
| 2001/0017440 | A1 * | 8/2001 | Minamishin et al. | 271/10.11 |
| 2004/0100010 | A1 * | 5/2004 | Huang et al. | 271/10.01 |
| 2006/0180978 | A1 * | 8/2006 | Aoki et al. | 271/10.01 |
| 2006/0202404 | A1 * | 9/2006 | Tokutsu | 271/4.01 |
| 2006/0220297 | A1 * | 10/2006 | Kusumi | 271/10.01 |
| 2009/0115120 | A1 * | 5/2009 | Mitsuya et al. | 271/10.03 |
| 2010/0148423 | A1 * | 6/2010 | Morita et al. | 271/10.03 |

FOREIGN PATENT DOCUMENTS

| | | |
|---|---|---|
| JP | 2001-031284 | 2/2001 |
| JP | 3408049 | 3/2003 |
| JP | 2005-324872 | 11/2005 |

OTHER PUBLICATIONS

English language abstract of JP 09-216742, Aug. 19, 1997, Japan.

* cited by examiner

*Primary Examiner* — Kaitlin S. Joerger
*Assistant Examiner* — Prasad Gokhale
(74) *Attorney, Agent, or Firm* — Harness, Dickey & Pierce, P.L.C.

(57) ABSTRACT

A document feeding device includes a carrying unit capable of carrying documents, a drawing device drawing and supplying the documents, a drawing device drive source driving the drawing device, a separation unit including a separation device to separate the documents one by one, a separation device drive source driving the separation device, a conveying device conveying the documents, a reading unit including a reading device to read information of the documents, a discharge device discharging the documents, a first document detector provided between a document set position and the separation unit to detect the documents, and a second document detector provided downstream of the separation unit and near a separation position to detect the documents. The first and second document detectors detect the trailing end of each of the documents to control the operation of the drawing device on the basis of the result of the detection.

11 Claims, 8 Drawing Sheets

DOCUMENT FEEDING DEVICE, IMAGE FORMING APPARATUS INCLUDING SAME, AND CONTROL METHOD FOR THE DOCUMENT FEEDING DEVICE

CROSS-REFERENCE TO RELATED APPLICATIONS

The present patent application claims priority pursuant to 35 U.S.C. §119 from Japanese Patent Application No. 2009-050523, filed on Mar. 4, 2009 in the Japan Patent Office, which is hereby incorporated by reference herein in its entirety.

BACKGROUND OF THE INVENTION

1. Field of the Invention

Example embodiments of the present patent application relate to a document feeding device, an image forming apparatus including the document feeding device, and a control method for the document feeding device, and more particularly, to a document feeding device that conveys multiple documents by feeding one by one to a document reading device, an image forming apparatus including the document feeding device, and a control method of the document feeding device for controlling sheet feeding of the documents.

2. Discussion of the Related Art

In so-called optical character recognition (OCR) technology, in which a scanner reads an image of a sheet-like document, for example, to convert the image into electronic data to be used as text or image data, and in a so-called copying technology, which makes a copy of a sheet-like document, for example, a document feeding device including a separation mechanism is often used. The document feeding device feeds and conveys a plurality of documents by automatically and sequentially extracting and separating the documents one by one from a document bundle.

As an example of such a document feeding device, there is a background document feeding device that draws documents from a document bundle, separates only the topmost document to be read from the other documents, detects whether or not there is a next document, and repeats the operation of drawing and separating documents until there is no next document.

In recent years, a demand for high-speed processing capability of this type of document feeding device has become particularly prominent due to an increasing need for OCR technology and a demand for increased productivity, for example. To satisfy such demand for a high-speed processing capability, techniques for increasing the document reading speed and reducing the intervals between documents read in the reading operation have been developed. Accordingly, there is also an increasing need for high-speed operation, in which documents to be read are reliably separated and fed one by one from a document bundle.

In the document separating operation, however, only the first document to be fed is conveyed, and the second and subsequent documents are prevented from being fed or in some cases are conveyed in the reverse direction. Therefore, mutually conflicting operations are required for the first document (hereinafter occasionally referred to as the previous document, for convenience sake) and the second or subsequent document (hereinafter occasionally referred to as the next document, for convenience sake). As a result, the positioning of the next document varies and becomes unpredictable after the completion of the feeding operation of the previous document.

To increase the speed of the separating operation, it is desirable to feed the next document as soon as possible after the trailing end of the previous document passes a predetermined sensor position. However, due to the unpredictable separating operation, i.e., due to the varied and unpredictable position of the next document after the conveyance of the previous document, it is difficult to efficiently control the feeding timing by predicting the position of the next document, i.e., the second or subsequent document. This difficulty presents a major obstacle to improving the high-speed separating operation.

To facilitate an understanding of the matter, the above-described phenomenon will now be described in greater detail with reference to FIGS. 1A to 2D. FIGS. 1A to 1F are enlarged schematic cross-sectional views illustrating an example of a separation mechanism of the background document feeding device. FIGS. 2A to 2D are schematic cross-sectional views illustrating a variety of leading end positions of the next document after the feeding of the previous document in the separation mechanism of the background document feeding device. The drawings illustrate a document bundle 1, a pickup roller 7, a document set sensor SN5, a feeding belt 9, a separation roller 10, a document detection sensor SN2, a document contact amount detection sensor 11, and a pair of pullout rollers 12.

FIG. 1A is a schematic cross-sectional view illustrating an enlarged view of the separation mechanism of the document feeding device, wherein the set document bundle 1 is going to be fed. In this example, the document set sensor SN5 first detects that the document bundle 1 has been placed on a document table serving as a carrying unit. In accordance with the detection of the document bundle 1, the pickup roller 7 descends to come into contact with the topmost surface of the document bundle 1, and rotates in the clockwise direction in the drawing to feed a document between the feeding belt 9 and the separation roller 10, and area that is hereinafter referred to as a document separation nip portion.

In this conveying operation, the feeding belt 9 stretched over belt pulleys with a predetermined tension, for example, is also rotated in the clockwise direction in synchronization with the rotation of the pickup roller 7 as the belt pulleys rotate. Due to the rotating operation of the feeding belt 9, the document (hereinafter referred to as the document P) is conveyed to the document separation nip portion as illustrated in FIG. 1B. In this process, the feeding belt 9 is pressed against the separation roller 10, which is provided to face the feeding belt 9 at the document separation nip portion as described above, at a predetermined pressure. Meanwhile, the separation roller 10 is frictionally driven via a torque limiter, not illustrated, having a predetermined amount of set torque. When the separation roller 10 is in direct engagement with the feeding belt 9 or in engagement with the feeding belt 9 with the document P interposed therebetween, the separation roller 10 is rotated in the counterclockwise direction in the drawing in accordance with the rotation of the feeding belt 9. However, the force for rotating the separation roller 10 in accordance with the rotation of the feeding belt 9 is set to be smaller than the torque of the torque limiter when two or more documents enter the document separation nip portion. Therefore, the separation roller 10 is configured to rotate in the clockwise direction, which is the original driving direction, to push back the extra document, i.e., the next document, to prevent a plurality of documents from being conveyed at the same time.

As the single document, i.e., the previous document P separated from the other documents in FIG. 1B is further conveyed, the leading end of the previous document P reaches the position of the document detection sensor SN2 as illustrated in FIG. 10. Triggered by the leading end of the previous document P reaching the document detection sensor SN2, the pickup roller 7 ascends to complete the separating operation. It is not necessary that the ascent of the pickup roller 7 coincide with the arrival of the previous document P at the document detection sensor SN2. Thus, a slight time lag may be set.

Even after the pickup roller 7 is lifted out of the way in the above-described sequence of operations, the feeding belt 9 still continues to rotate. Therefore, the previous document P separated from the document bundle 1 is further conveyed by the feeding belt 9. Then, as illustrated in FIG. 1D, the leading end of the previous document P enters between the pair of opposed pullout rollers 12 (an area that is hereinafter referred to as a pullout nip portion), which are in contact with each other but have not yet started rotating. In this process, after the leading end of the previous document P passes the document contact amount detection sensor 11, the feeding belt 9 is further driven for a time period determined by the contact amount. As a result, the previous document P is rolled up against the pullout rollers 12 with a predetermined force. Due to the action of the previous document P attempting to return to its original shape, which is caused by this bending of the previous document P, the leading end of the previous document P is ultimately positioned in front of the pullout nip portion formed by the pair of pullout rollers 12.

Thereafter, the pair of pullout rollers 12 start to be driven, as illustrated in FIG. 1E, thereby further conveying the previous document P, as illustrated in FIG. 1F, to a document reading device that is not illustrated in FIGS. 1A to 1F.

According to the above-described configuration of the related-art document feeding device, even if the trailing end of the previous document P is normally extracted from the document bundle 1, the passage of the trailing end of the previous document P is detected, at the earliest, after the trailing end of the previous document P passes the document detection sensor SN2. Accordingly, the feeding of the next document starts only after the trailing end of the previous document P passes the document detection sensor SN2. In a state in which the pair of pullout rollers 12 is moving, as illustrated in FIGS. 1E and 1F, the feeding belt 9 is not driven. However, with the use of a one-way clutch and so forth, for example, the feeding belt 9 is configured to be rotated in accordance with the conveying operation of the previous document P.

As described above, even if the trailing end of the previous document P is normally extracted from the document bundle 1 set on the document table or passes the document separation nip portion, it is difficult for the above-described configuration of the background document feeding device to promptly detect the passage of the trailing end of the previous document P through the document bundle 1 or the document separation nip portion. Therefore, a signal necessary for starting the feeding of the next document (hereinafter referred to as the next document P') is not obtained. As a result, the feeding of the next document P' is not started. The feeding of the next document P' starts only after the trailing end of the previous document P passes the document detection sensor SN2. This state of affairs is not conducive to improving high-speed operation.

In addition, when the trailing end of the previous document P passes the document detection sensor SN2 and the conveying operation of the next document P' is about to start, the position of the leading end of the next document P' is moved forward somewhat in some cases during the conveyance of the previous document P for reasons that are described below. Consequently, the position of the leading end of the next document P' is inconstant and unpredictable. For example, the leading end of the next document P' may stay substantially at the initial document set position, as illustrated in FIG. 2A, or may be conveyed to a position in front of the feeding belt 9, as illustrated in FIG. 2B. Further, the leading end of the next document P' may reach the document separation nip portion formed by the feeding belt 9 and the separation roller 10, as illustrated in FIG. 2C, or may be located inside or project from behind the document separation nip portion, as illustrated in FIG. 2D.

The above phenomenon is attributable to frictional force interfering with movement in opposite directions, which acts between the previous document P and the next document P', i.e., frictional force generated in the feeding of the previous document P and resultantly affecting the next document P'. Further, if the next document P' has reached the document separation nip portion during the operation of separating the previous document P from the document bundle 1, the next document P' may also be subjected to the action of the separation roller 10 to push the extra document backward. Therefore, it is very difficult to predict and control the point at which the movement of the next document P' stops, i.e., the behavior of the leading end of the next document P', from the conveying operation of the previous document P.

In addition, users use a variety of different types of document sheets. Therefore, the coefficient of friction of the documents can be expected to vary depending on the type of documents used. Further, the coefficient of friction of the separation roller 10 also varies due to retention of paper particles and so forth from the documents. Due to the variation in the coefficient of friction caused by the difference in sheet type and/or the paper particles and so forth of the documents, therefore, the frictional force and the reverse conveying force applied to the next document P' can also be expected to vary. From this perspective also, then, it is understood that the prediction and control of the position of the next document P' is substantially difficult.

It is conceivable that the position of the document detection sensor SN2 may simply be shifted to the upstream side in the document conveying direction to detect the passage of the trailing end of the previous document P as soon as possible. However, the position of the leading end of the next document P' varies, as described above. Accordingly, if the next document P' is conveyed partially overlapping the previous document P, and if the leading end of the next document P' reaches the document detection sensor SN2 shifted to the upstream position, the document detection sensor SN2 might fail to detect the boundary between the previous document P and the next document P'. As a result, a so-called conveyance jam is caused by abnormal retention of the documents.

In terms of controlling an image forming apparatus, in an attempt to increase productivity by optimizing the start timing of the feeding of the next document P', the above-described failure to reliably detect the variable position of the leading end of the next document P' and precisely separate the next document P' in the next separating operation is viewed as a so-called conveyance jam occurring. Therefore, in the configuring of the related-art document feeding device, for reasons of safety it is necessary to implement such control assuming the shortest document interval between the previous document P and the next document P', as illustrated in FIG. 2D. That is, if it is not certain that the trailing end of the previous document P has passed the document detection sensor SN2, it is not allowed to perform the control of starting the feeding of the next document P', the leading end of which might have reached the document separation nip portion. In fact, however, an unnecessarily long document interval is set between the previous document P and the next document P' in the above-described control of the background document feeding device in consideration of safety, because in practice there are cases like that illustrated in FIG. 2A, in which the control of starting the feeding of the next document P' can be performed before the document detection sensor SN2. Therefore, such overly conservative control presents an obstacle to increased productivity.

SUMMARY OF THE INVENTION

This patent specification describes a document feeding device. In one example embodiment, a document feeding device includes a carrying unit capable of carrying thereon a plurality of documents, a drawing device to draw and supply the carried documents, a drawing device drive source to drive the drawing device, a separation unit including a separation device to separate the supplied documents one by one, a separation device drive source independent of the drawing device drive source and to drive the separation device, a conveying device to convey the separated documents, a reading unit including a reading device to read information of the conveyed documents, a discharge device to discharge the read documents, a first document detector provided between a document set position of the carrying unit and the separation unit to detect the documents, a second document detector provided downstream of the separation unit and near a separation position of the separation unit to detect the documents, and a controller. At least the first document detector detects the trailing end of each of the documents in sheet feeding of the documents, and the controller controls operation of the drawing device based on detection results obtained by the first document detector and the second document detector.

The control of the operation of the drawing device may be a pickup synchronization control which lowers a pickup roller of the drawing device by predicting the timing at which the trailing end of each of the second and subsequent documents passes the first document detector, based on the length of a first document.

The pickup synchronization control may not be performed when a mixed mode is set to read documents of different document lengths.

The control of the operation of the drawing device may be a high-speed conveyance control which sets the document conveying speed of the drawing device to be higher than the document conveying speed of the separation device.

Each of the second and subsequent documents may be subjected to a pre-separation control which first drives the drawing device to rotate in a direction away from a reading position and then drives the drawing device to rotate in the opposite direction to convey the document toward the reading position.

Whether or not to perform the high-speed conveyance control and the pre-separation control may be determined on the basis of whether or not the first document detector has detected the trailing end of the document preceding each of the second and subsequent documents.

This patent specification further describes an image forming apparatus. In one example embodiment, an image forming apparatus includes the above-described document feeding device, and an image forming mechanism configured to form images of documents fed by the document feeding device.

This patent specification further describes a control method for a document feeding device. In one example embodiment, a control method for the above-described document feeding device includes detecting a trailing end of each of the documents in sheet feeding of the documents using the first document detector and the second document detector, predicting the timing at which the trailing end of each of second and subsequent documents passes the first document detector, and lowering a pickup roller of the drawing device based on the length of a first document.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1A:
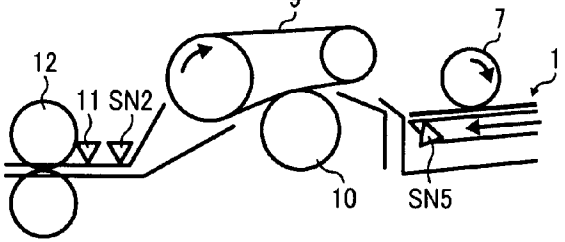
FIG. 1A BACKGROUND ART
FIGS. 1A to 1F are schematic cross-sectional views illustrating an example of a background document feeding device, particularly enlarged views of a separation mechanism of the document feeding device.
Figure 1B:
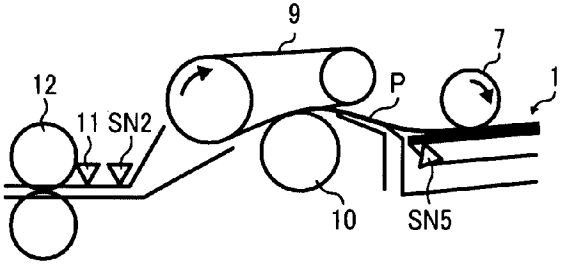
FIG. 1B BACKGROUND ART
Figure 1C:
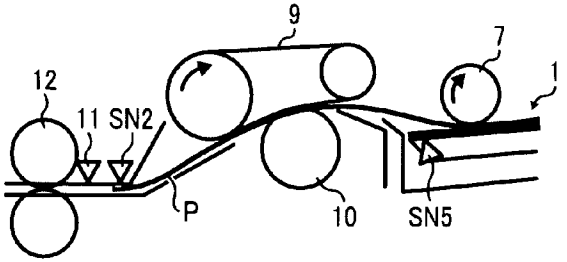
FIG. 1C BACKGROUND ART
Figure 1D:
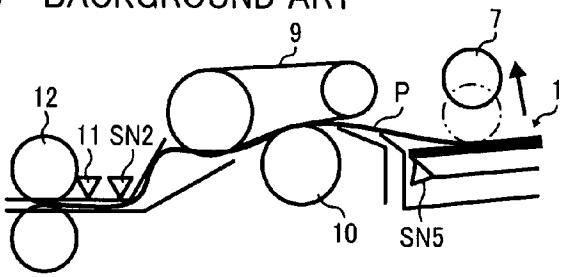
FIG. 1D BACKGROUND ART
Figure 1E:
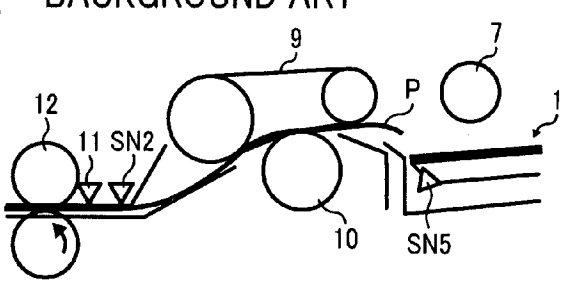
FIG. 1E BACKGROUND ART
Figure 1F:
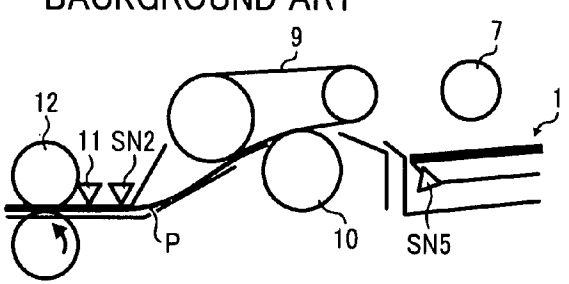
FIG. 1F BACKGROUND ART
Figure 2A:
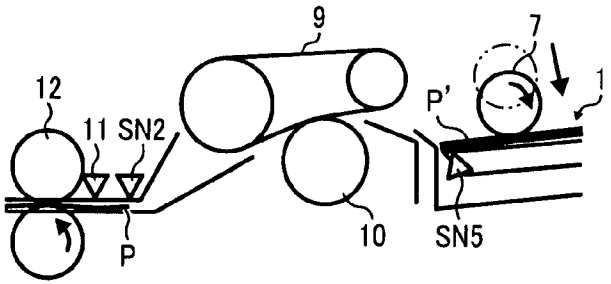
FIG. 2A BACKGROUND ART
FIGS. 2A to 2D are schematic cross-sectional views illustrating a variety of leading end positions of the next document after the feeding of the previous document in the separation mechanism of the background document feeding device.
Figure 2B:
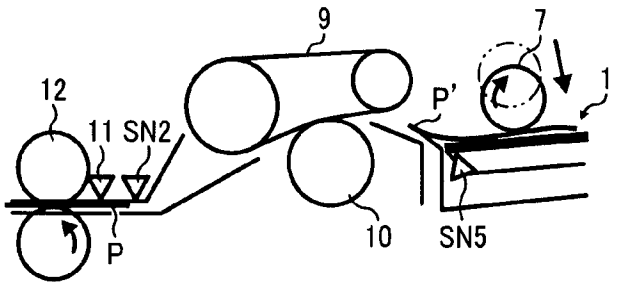
FIG. 2B BACKGROUND ART
Figure 2C:
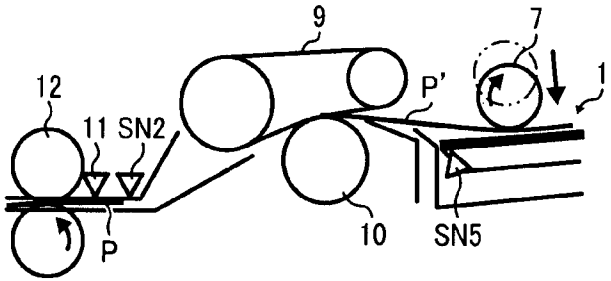
FIG. 2C BACKGROUND ART
Figure 2D:
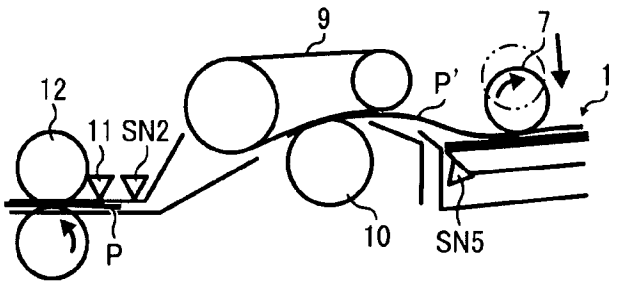
FIG. 2D BACKGROUND ART

In describing the example embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, particularly to FIGS. 3 to 7, example embodiments of the present patent application will be described below.

Figure 3:
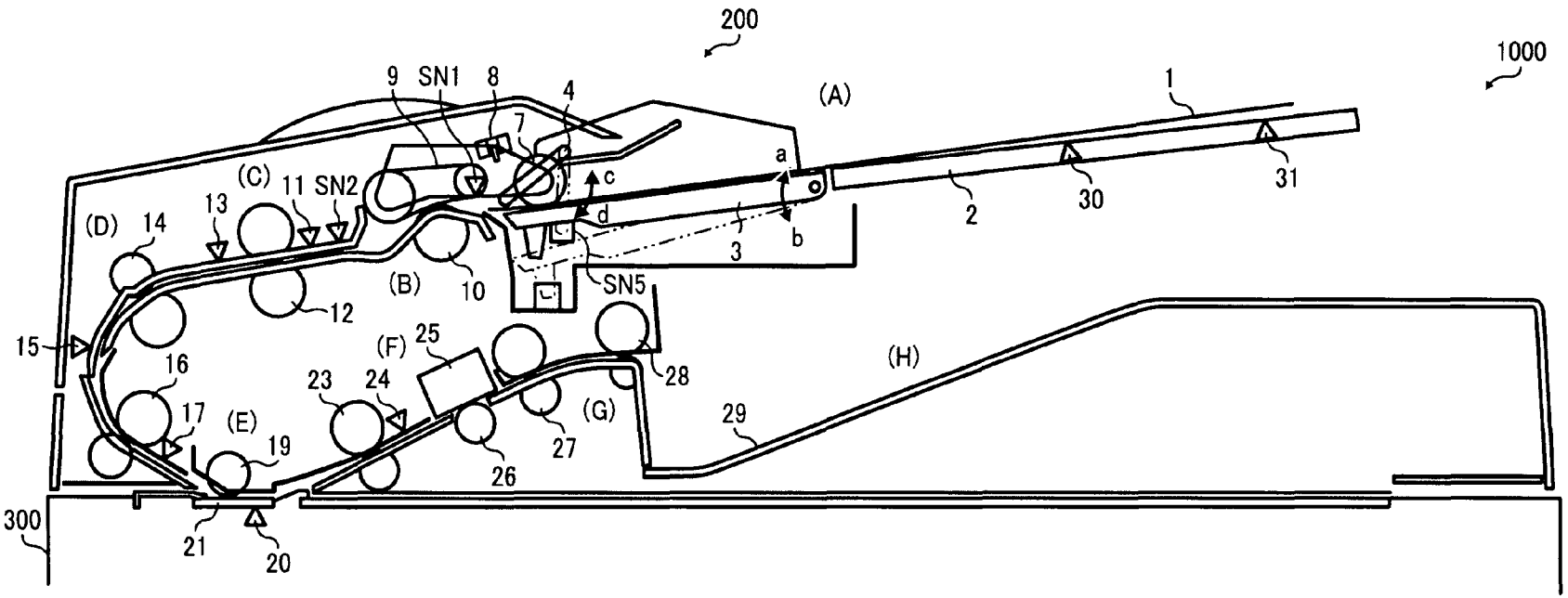
FIG. 3 is a cross-sectional view schematically illustrating an example of a document feeding device according to an embodiment of the present patent application.
Figure 4:
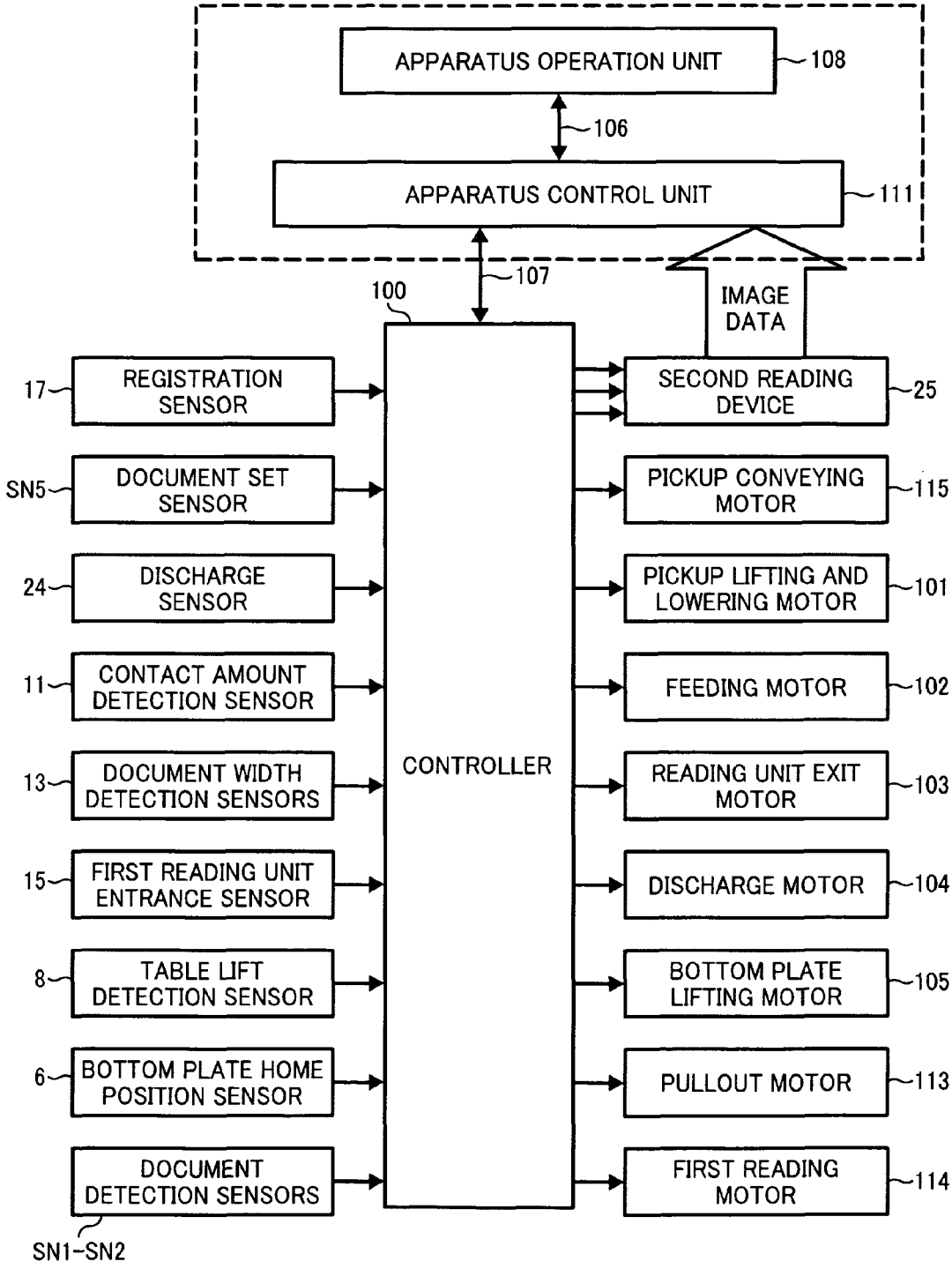
FIG. 4 is a control block diagram of a control unit for controlling the document feeding device illustrated in FIG. 3.

FIG. 3 is a cross-sectional view schematically illustrating an example of a document feeding device 200 according to an embodiment of the present patent application. FIG. 4 is a control block diagram of a control unit for controlling the document feeding device 200. With reference to FIGS. 3 and 4, the basic configuration, operation, and effect of the document feeding device 200 will be first described.

The document feeding device 200 illustrated in FIG. 3 is an automatic document conveying device included in an image forming apparatus 1000 such as a copier, for example. The document feeding device 200 is roughly divided into a document setting unit A, a separating and feeding unit B, a registration unit C, a document turning unit D, a first reading unit E, a second reading unit F, a sheet discharge unit G, and a stacking unit H. The document setting unit A sets a document bundle including documents to be read. The separating and feeding unit B separates and feeds the documents one by one from the set document bundle. The registration unit C temporarily stops each of the documents conveyed and brought into contact therewith to adjust the position of the leading end of the document, and thereafter draws and conveys the document. The document turning unit D turns the document conveyed thereto. The first reading unit E reads the front surface image (i.e., a first image) of the document via a contact glass and so forth. The second reading unit F reads the rear surface image (i.e., a second image) of the document, the front surface image of which has been read. The sheet discharge unit G discharges the read document to the outside of the image forming apparatus 1000. The stacking unit H carries and holds thereon the discharged document. The respective units described above include drive devices 101 through 105 and 113 through 115 for conveying the document, and a controller 100 for controlling a sequence of operations, as illustrated in FIG. 4. The document feeding device 200 is configured to feed and convey the documents by appropriately controlling the drive devices 101 through 105 and 113 through 115 and so forth with the use of the controller 100.

The document feeding device 200 includes a document table 2, a movable table portion 3, a set filler 4, a document set sensor SN5, a pickup roller 7, a table lift detection sensor 8, a feeding belt 9, a separation roller 10, a separation sensor SN1, a document detection sensor SN2, a document contact amount detection sensor 11, pullout rollers 12, document width detection sensors 13, intermediate rollers 14, a first reading unit entrance sensor 15, first reading unit entrance rollers 16, a registration sensor 17, a conveying roller 19, a document reading position 20, a contact glass 21, first reading unit exit rollers 23, a discharge sensor 24, a second reading device 25, a second reading unit roller 26, second reading unit exit rollers 27, sheet discharge rollers 28, a sheet discharge tray 29, and document length detection sensors 30 and 31.

In the present configuration, a document bundle 1 (illustrated in FIGS. 5A through 5I) including documents to be read is set on the document table 2, with the front surfaces of the documents facing upward, for example. The document table 2, which serves as a carrying unit, is provided with the movable table portion 3. Preferably, the document table 2 is configured such that, in the document setting process, the width direction of the set document bundle 1 is aligned with a direction perpendicular to the document conveying direction by side guides, not illustrated. The set state of the documents is detected by the set filler 4 and the document set sensor SN5 which serves as a document set recognition device. Information on the document set state is transmitted to an apparatus control unit 111 via the controller 100 by an interface (I/F) 107, as illustrated in FIG. 4. Further, the document length detection sensors 30 and 31 are provided to the document table 2 to detect the approximate length of the documents in the document conveying direction. The document length detection sensors 30 and 31 need to be arranged to be able to determine at least whether the detected document size is the length or the width of the documents of the same size. Each of the document length detection sensors 30 and 31 may be a reflective sensor or an actuator-type sensor capable of detecting a single document.

The movable table portion 3 provided to the document table 2 is connected to a bottom plate lifting motor 105 (illustrated in FIG. 4). The movable table portion 3 is configured to be lifted and lowered by the bottom plate lifting motor 105 in directions a-b illustrated in FIG. 3. When the document set sensor SN5, for example, detects that the document bundle 1 has been set on the document table 2, the bottom plate lifting motor 105 is driven to lift the movable table portion 3, such that the topmost surface of the document bundle 1 comes into contact with the pickup roller 7 which serves as a document drawing device. A bottom plate home position sensor 6, illustrated in FIG. 4, is connected to the bottom plate lifting motor 105 to detect whether the movable table portion 3 is returned to its home position.

The pickup roller 7 coming into contact with the topmost surface of the document bundle 1 can also be lifted and lowered by a pickup lifting and lowering motor 101 (illustrated in FIG. 4) in directions c-d illustrated in FIG. 3, with the use of a cam mechanism. The pickup roller 7 is also lifted in the c direction, when the movable table portion 3 is lifted and the upper surface of the document bundle 1 presses the pickup roller 7. The upper limit of the lifting operation of the pickup roller 7 can be detected by the table lift detection sensor 8.

When a user operates an apparatus operation unit 108 (illustrated in FIG. 4) of the image forming apparatus 1000, a command to start the operation of the image forming apparatus 1000 is transmitted to the apparatus control unit 111 via an interface (I/F) 106. Then, a document feeding signal is transmitted from the apparatus control unit 111 to the controller 100 via the interface 107, a pickup conveying motor 115 (illustrated in FIG. 4) is driven to drive and rotate the pickup roller 7, and a document on the document table 2 is picked up. Ideally, only one document is picked up in the pickup operation. In practice, however, sometimes a plurality of documents is picked up. Further, the rotation direction of the pickup roller 7 corresponds to the direction of conveying the document to the next stage, i.e., the separating and feeding unit B. The pickup roller 7 is driven to rotate in the clockwise direction in FIG. 3.

In the separating and feeding unit B, the circular feeding belt 9 stretched over belt pulleys and the separation roller 10 are pressed against each other at a predetermined pressure. Thereby, the feeding belt 9 and the separation roller 10 form a document separation nip portion, and constitute a separation device which separates documents one by one. The feeding belt 9 is driven by a feeding motor 102 (illustrated in FIG. 4) to rotate in the document feeding direction (i.e., the clockwise direction in FIG. 3 in the present embodiment). Meanwhile, the separation roller 10, which is also driven to rotate by the feeding motor 102, is driven to rotate in the opposite direction to the document feeding direction to separate the topmost document from the document located thereunder.

The above operation will now be described in greater detail. The separation roller 10 is connected to the power of the feeding motor 102 via a torque limiter. When the separation roller 10 is in direct contact with the feeding belt 9 or in contact with the feeding belt 9 with only one document interposed therebetween, the torque limiter operates with rotary torque of the feeding belt 9, thereby rotating the separation roller 10 in the counterclockwise direction in FIG. 3, i.e., the opposite direction to the set rotation direction. Meanwhile, if multiple documents enter the document separation nip portion, the separation roller 10 is rotated in the clockwise direction, i.e., the original rotation direction due to the torque of the torque limiter set to be lower than the torque with which the feeding belt 9 rotates the separation roller 10. Accordingly, the separation roller 10 exhibits an effect of pushing back an extra document. Therefore, the above-described operation ensures the operation of reliably separating and feeding the documents one by one from the document bundle 1.

Then, the document separated from the other documents due to the action of the feeding belt 9 and the separation roller 10 at the document separation nip portion is further conveyed in accordance with the rotation of the feeding belt 9, and the leading end of the document is detected by the document contact amount detection sensor 11. The document is then further conveyed and brought into contact with a pullout nip portion formed by the pair of pullout rollers 12 (having not yet been driven) serving as a conveying device. In this process, the feeding belt 9 is driven for a predetermined time or distance after the above-described detection by the document contact amount detection sensor 11, i.e., a time or distance that is determined by the contact amount, and then is stopped. As a result, the document is brought into contact with the pullout rollers 12 with a predetermined amount of bending. Due to the action of the document attempting to return to its original shape, which is caused by the bending of the document, the leading end of the document is positioned in front of the pullout nip portion formed by the pair of pullout rollers 12. That is, so-called skew correction is performed. In this operation, the pickup lifting and lowering motor 101 is driven to retract the pickup roller 7 from the upper surface of the document bundle 1 and the document is conveyed solely by the conveying force of the feeding belt 9.

Herein, the pullout rollers 12 exhibit the above-described skew correction function, and also convey the separated and skew-corrected document to the intermediate rollers 14 provided in the document turning unit D to convey the document to the first reading unit E. It is also possible to drive the pullout rollers 12 to convey the document by causing the feeding motor 102 to drive and rotate the pullout rollers 12 in the opposite direction to the direction of driving the feeding belt 9 and the separation roller 10. That is, switching may be performed between the forward rotation and the backward rotation of the same feeding motor 102 to drive the feeding belt 9 and the separation roller 10 or to drive the pullout rollers 12. In this case, the number of drive systems is reduced, and thus necessary space and cost are reduced. However, this configuration is disadvantageous in terms of productivity in that the feeding belt 9 and the pickup roller 7 are not driven before the trailing end of the previous document P passes the pullout rollers 12. Meanwhile, a configuration which drives the pullout rollers 12 by using a pullout motor 113 (illustrated in FIG. 4) as an independent drive source is capable of reducing the rise time and the fall time of the motor, and thus is advantageous in terms of increased productivity.

The plurality of document width detection sensors 13 are provided downstream of the pullout rollers 12 in the document conveying direction. The document width detection sensors 13 are arranged in the depth direction perpendicular to the drawing plane of FIG. 3. The document width detection sensors 13 are configured to detect the size of the document, which is conveyed by the pullout rollers 12, in the width direction perpendicular to the document conveying direction. Meanwhile, the length of the document in the document conveying direction can be detected from motor pulses in accordance with the detection of the leading end and the trailing end of the document by the document contact amount detection sensor 11.

As the pullout rollers 12 and the intermediate rollers 14 are driven to rotate, the document is conveyed from the registration unit C to the document turning unit D. In this conveying process, the conveying speed in the section between the registration unit C and the document turning unit D can be set to be higher than the conveying speed in the first reading unit E to reduce the processing time taken to send the document to the first reading unit E, which is configured to include the contact glass 21 and the conveying roller 19.

In this configuration, which increases the conveying speed in the section between the registration unit C and the document turning unit D, when the leading end of the document is detected by the first reading unit entrance sensor 15, the conveying speed starts to be reduced. That is, prior to the entrance of the leading end of the document into a first reading unit entrance nip portion formed by the pair of first reading unit entrance rollers 16, the conveying speed of the document starts to be reduced to equal the conveying speed in the first reading unit E. At the same time, upon detection of the leading end of the document by the first reading unit entrance sensor 15, a first reading motor 114 (illustrated in FIG. 4) is driven to drive the first reading unit entrance rollers 16 connected to the power of the first reading motor 114. In addition, a reading unit exit motor 103 (illustrated in FIG. 4) is driven to drive the first reading unit exit rollers 23 and the second reading unit exit rollers 27 connected to the power of the reading unit exit motor 103.

As the registration sensor 17 detects the passage of the leading end of the document conveyed through the pair of first reading unit entrance rollers 16, the conveying speed of the document is reduced in the above-described manner over a predetermined conveying distance. Then, the document is temporarily stopped in front of the document reading position 20, and a registration stop signal is transmitted to the apparatus control unit 111 via the interface 107.

Then, upon output of a reading start signal from the apparatus control unit 111, the document stopped for registration is conveyed again, with the conveying speed of the document increased to a predetermined conveying speed until the leading end of the document reaches the document reading position 20. Upon arrival of the leading end of the document at a reading area, which is detected on the basis of a pulse count of the first reading motor 114 that drives the first reading unit entrance rollers 16, a gate signal representing an effective image area of the document in the sub-scanning direction is transmitted to the apparatus control unit 111 until the trailing end of the document passes the first reading unit E.

The document conveyed to the reading area is read by a document reading unit 300 (i.e., a scanner) included in the image forming apparatus 1000.

If only one side of the document is to be read by the document reading device 300, the document having passed the first reading unit E is directly conveyed to the sheet discharge unit G through the second reading unit F. In this conveying operation, upon detection of the leading end of the conveyed document by the discharge sensor 24, a discharge motor 104 (illustrated in FIG. 4) is driven to rotate the upper sheet discharge roller 28 in the counterclockwise direction in FIG. 3. Thereby, the document is discharged onto the stacking unit H which carries and holds thereon a discharged document, i.e., onto the sheet discharge tray 29. In this document discharging operation, immediately before the trailing end of the document passes a discharge nip portion formed by the pair of sheet discharge rollers 28, the speed of the discharge motor 104 driving the sheet discharge rollers 28 is reduced to prevent the document to be discharged onto the sheet discharge tray 29 from jumping the tray.

By contrast, if both sides of the document is read by the document reading device 300, in addition to the single-surface reading operation described above another document reading operation by the second reading unit F is performed. In the reading of the document by the second reading unit F, upon arrival of the leading end of the document to the second reading device 25, which is detected on the basis of the pulse count of the reading unit exit motor 103 since the detection of the passage of the leading end of the document by the discharge sensor 24, a gate signal representing an effective image area of the document in the sub-scanning direction is transmitted until the trailing end of the document passes the second reading device 25. The second reading unit roller 26 facing the second reading device 25 is provided to prevent the document from bending while being read by the second reading device 25. At the same time, the second reading unit roller 26 also serves as a reference white member used to acquire so-called shading data.

The document feeding device 200 according to the present embodiment will be described with reference to FIGS. 5A to 5I illustrating enlarged views of a separation mechanism of the document feeding device 200. As observed in FIG. 5A, the document detection sensor SN2, which serves as a second document detector capable of detecting the presence of a document conveyed thereto, is provided between the document separation nip portion of the separation mechanism formed by the feeding belt 9 and the separation roller 10 and the pair of pullout rollers 12, which serves as a document conveying device. In the present embodiment, however, the separation sensor SN1, which serves as a first document detector capable of detecting the presence of a document, is also provided upstream of the document separation nip portion in the document conveying direction, i.e., immediately in front of the document separation nip portion formed by the feeding belt 9 and the separation roller 10. Herein, the drive source of the pickup roller 7 is the pickup conveying motor 115, and the drive source of the feeding belt 9 of the separation mechanism is the feeding motor 102.

The document feeding operation of the present embodiment will now be described. The present embodiment is configured as follows. That is, when a user operates the apparatus operation unit 108, a signal for starting the document reading operation is transmitted to the apparatus control unit 111. Then, the controller 100 causes the pickup roller 7, which serves as a document drawing device, to start feeding documents from the document bundle 1 set on the document table 2, which serves as a carrying unit (see FIG. 5A). Thereafter, the topmost document reaches the feeding belt 9 included in the separation device formed by the feeding belt 9 and the separation roller 10 (see FIG. 5B). With the action of the feeding belt 9, the document is further conveyed to the document separation nip portion (see FIG. 5C). In the document separation nip portion, the document (hereinafter referred to as the document P) is separated from the other documents. Then, the document P is further conveyed by the feeding belt 9, and passes the document detection sensor SN2 (see FIG. 5D). The document P is then brought into contact with the pair of pullout rollers 12, which serve as a conveying device for conveying the document to the first reading unit E (see FIG. 5E). There, the leading end of the document P is positioned in front of the pullout nip portion formed by the pair of pullout rollers 12, and the document P is further conveyed (see FIG. 5F) to the document reading device 300. Then, the document P is further conveyed and the trailing end of the document P passes the separation sensor SN1 (see FIG. 5G). If a next document P' passes the separation sensor SN1 in a manner similar to the previous document P illustrated in FIGS. 5H and 5I, the next document P' may be subjected to a high-speed sheet feeding including a high-speed conveyance control and a pre-separation control, details of which are described later.

TABLE 1 illustrates ON and OFF states of the respective sensors and the driven state and the non-driven state of the respective motors in FIGS. 5A to 5I.

TABLE 1

| | Contact amount detection sensor | Document detection sensor | | Pickup conveying motor | Feeding motor | Pull-out motor | FIG. | |
|---|---|---|---|---|---|---|---|---|
| | 11 | S2 | S1 | 115 | 102 | 113 | No | Operation |
| 1 | 0 | 0 | 0 | 1 | 0(1) | 0 | 5A | Document is picked up. |
| 2 | 0 | 0 | 1 | 1 | 1 | 0 | 5B | Document separating operation starts. |
| 3 | 0 | 0 | 1 | 1 | 1 | 0 | 5C | Document reaches separation nip portion. |
| 4 | 0 | 1 | 1 | 1 | 1 | 0 | 5D | Document reaches sensor SN2. |
| 5 | 1 | 1 | 1 | 1 | 1 | 0 | 5E | Document reaches pullout rollers and is bent. |
| 6 | 1 | 1 | 1 | 0 | 0 | 1 | 5F | Document pullout operation is performed. |
| 7 | 1 | 1 | 1→0 | 0→1 | 0(1) | 1 | 5G | Trailing end of document P has passed sensor SN1. Document P' has not reached sensor SN1. |
| 8 | 1 | 1 | 1 | 0 | 0 | 1 | 5H | Trailing end of document P has passed sensor SN1. Document P' reaches sensor SN1. |
| 9 | 1 | 1→0 | 1 | 0→1 | 0→1 | 1 | 5I | Trailing end of document P has passed sensor SN2. Document P' is passing sensor SN1. |

In TABLE 1, "0" indicates that the corresponding sensor has not detected a document, or that the corresponding motor is not driven. By contrast, "1" indicates that the corresponding sensor has detected a document, or that the corresponding motor is driven.

Figure 6:
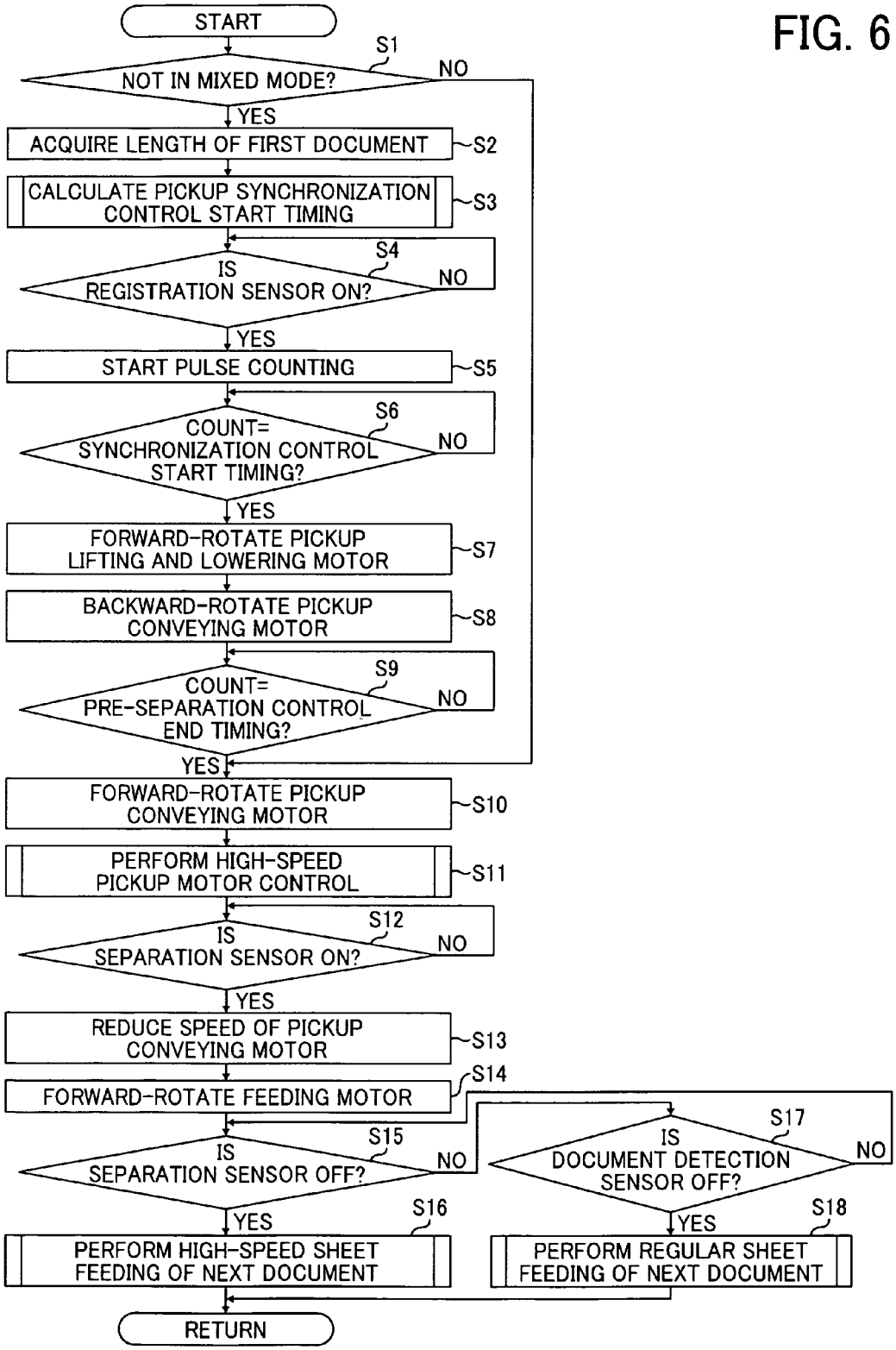
FIG. 6 is a diagram illustrating a control flowchart of high-speed sheet feeding according to an embodiment of the present patent application.

In the present embodiment, the mutually independent drive sources are controlled in accordance with the sequence shown in the flowchart of FIG. 6 in the high-speed sheet feeding by the pickup roller 7 and the feeding belt 9.

At step S1 in FIG. 6, it is determined whether or not a mixed mode is OFF, i.e., whether or not the documents set on the document table 2 are all the same in document length in the document conveying direction. The above determination is made on the basis of, for example, whether or not a user has operated a button or the like indicating that documents of different document lengths have been set.

If the mixed mode if ON (NO at step S1), the process proceeds to step S10, which will described later. By contrast, if the mixed mode is OFF (YES at step S1), the document length of the first document is acquired by the separation sensor SN1 at step S2. On the basis of the thus-acquired document information, a calculation process is performed that calculates the start timing of a pickup synchronization control that lowers the pickup roller 7 by predicting the passing timing of the trailing end of each of the documents through the separation sensor SN1 at step S3.

Then, whether or not a registration sensor is ON is determined, for example, to determine whether or not the feeding of the next document P' is performed at step S4.

If the registration sensor is not ON (NO at step S4), the process is repeated until the registration sensor turns ON. If the registration sensor is NO (YES at step S4), upon output of a command to feed the next document P', the pulse count for the pickup synchronization control starts at step S5. Then, it is determined whether or not the counted pulse number has reached the pulse number corresponding to the timing predicted at step S3, at which the trailing end of the document passes the separation sensor SN1 at step S6.

If the counted pulse number has not yet reached the pulse number corresponding to the timing predicted at step S3 (NO at step S6), the process is repeated until the counted pulse number reaches the pulse number corresponding to the timing. If the counted pulse number has reached the pulse number corresponding to the timing predicted at step S3 (YES at step S6), the pickup lifting and lowering motor 101 is driven to rotate in the forward direction to lower the pickup roller 7 at step S7. With the above-described control, the operation of lowering the pickup roller 7 is completed in a relatively short time. Accordingly, the loss of time in the document drawing operation is reduced.

When the pickup roller 7 is thus lowered and brought into contact with the document, the pickup conveying motor 115 is driven to rotate in reverse to perform pre-separation control to rotate the pickup roller 7 in the direction of pushing the document backward at step S8. The time of this rotation is preset to be relatively short. Then, it is determined whether or not the number of the counted pulses has reached the pulse number corresponding to the previously set time at step S9.

If the number of the counted pulses has not yet reached the pulse number corresponding to the previously set time (NO at step S9), the process is repeated until the number of the counted pulses reaches the pulse number. If the number of the counted pulses has reached the pulse number corresponding to the previously set time (YES at step S9), the pickup conveying motor 115 is driven to rotate in the forward direction to rotate the pickup roller 7 in the direction of conveying the document toward the first reading unit E at step S10. In the above-described manner, the pickup roller 7 is first rotated in the direction away from the separation position, and then is rotated in the opposite direction to convey the document toward the separation position. Therefore, the next document P' is prevented from being conveyed in an overlapping manner with the previous document P, and is stopped at a position upstream of the separation sensor SN1. Accordingly, the probability of detecting the trailing end of the previous document P with the separation sensor SN1 is increased.

During the forward rotation of the pickup roller 7, a high-speed conveyance control is performed to reduce the interval between the previous document P and the next document P' at step S11. In the high-speed conveyance control, the speed of the pickup roller 7 conveying the next document P' is increased to be higher than the speed of the feeding belt 9 conveying the previous document P. Then, whether or not the separation sensor SN1 has detected the next document P' is determined at step S12.

If it is determined that the separation sensor SN1 has not detected the next document P' (NO at step S12), the process is repeated until the separation sensor SN1 detects the next document P'. If it is determined that the separation sensor SN1 has detected the next document P'(YES at step S12), the speed of the pickup conveying motor 115 is reduced to adjust the conveying speed of the pickup roller 7 to be equal to the conveying speed of the feeding belt 9 at step S13. Then, the feeding motor 102 is rotated in the forward direction at step S14.

Then, to detect whether or not the next document P' has passed the separation sensor SN1, it is determined whether or not the separation sensor SN1 has been turned OFF at step S15.

Figure 5A:
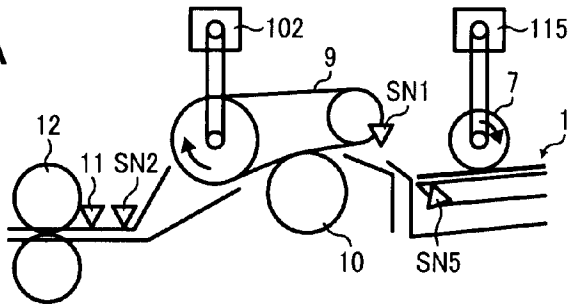
FIGS. 5A to 5I are schematic cross-sectional views illustrating the document feeding device according to an embodiment of the present patent application, particularly enlarged views of a separation mechanism of the document feeding device.
Figure 5B:
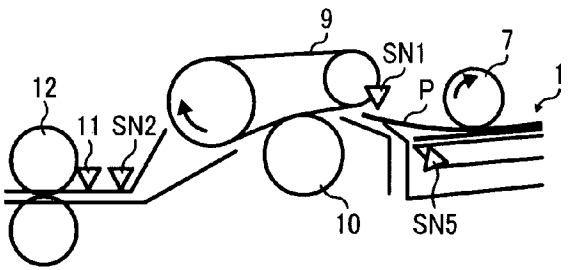
Figure 5C:
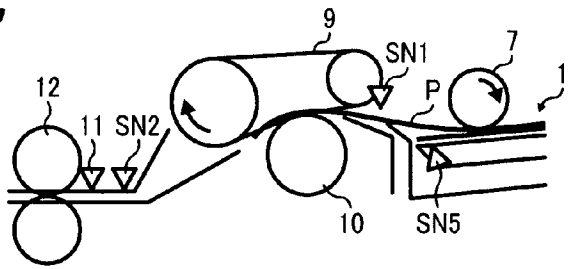
Figure 5D:
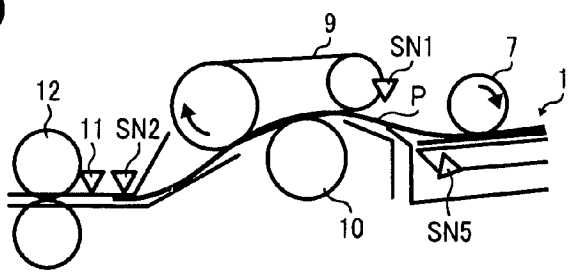
Figure 5E:
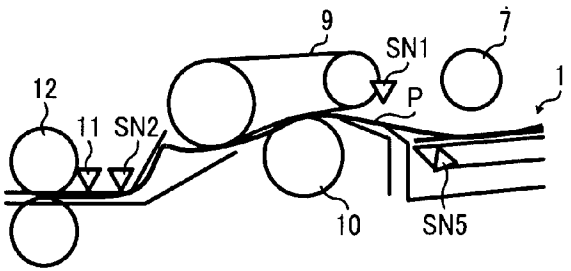
Figure 5F:
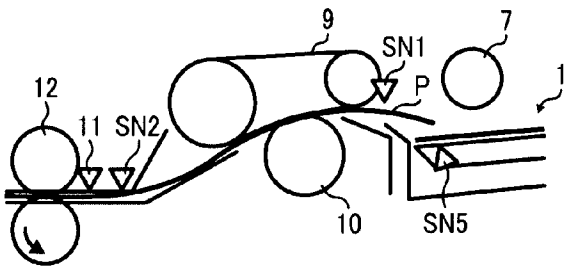
Figure 5G:
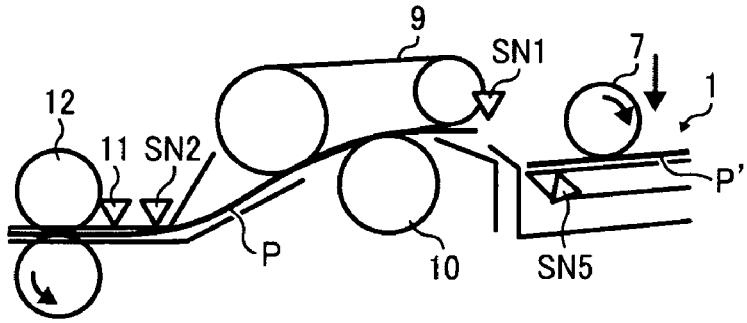
Figure 5H:
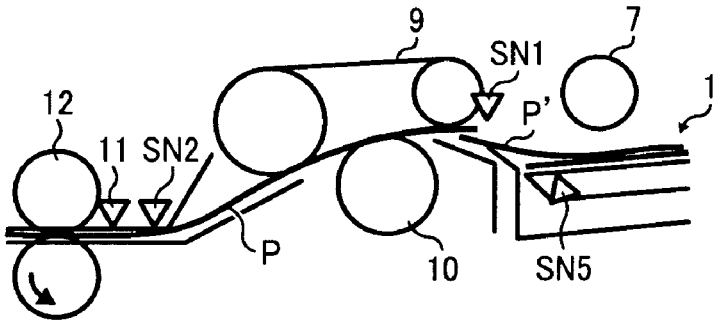
Figure 5I:
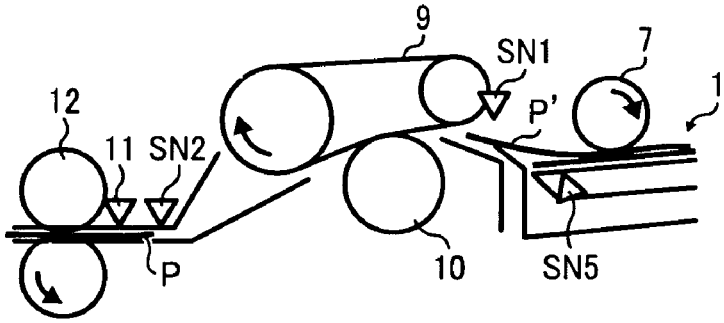

If the next document P' passes the separation sensor SN1 in a manner similar to the previous document P illustrated in FIG. 5H (YES at step S15), the next document P' is also subjected to the high-speed conveyance control of step S11 for increasing the speed of the pickup roller 7 and the high-speed sheet feeding including the pre-separation control of step S8 at step S16. Meanwhile, if the next document P' is drawn together with the previous document P and thus the separation sensor SN1 fails to turn OFF, as illustrated in FIG. 5I (NO at step S15), whether or not the document detection sensor SN2 has been turned OFF is determined at step S17. If the document detection sensor SN2 has not been turned OFF (NO at step S17), the process goes back to step S15. If the document detection sensor SN2 has been turned OFF (YES at step S17), the next document P' is subjected to regular sheet feeding, as indicated in step S18.

Figure 7:
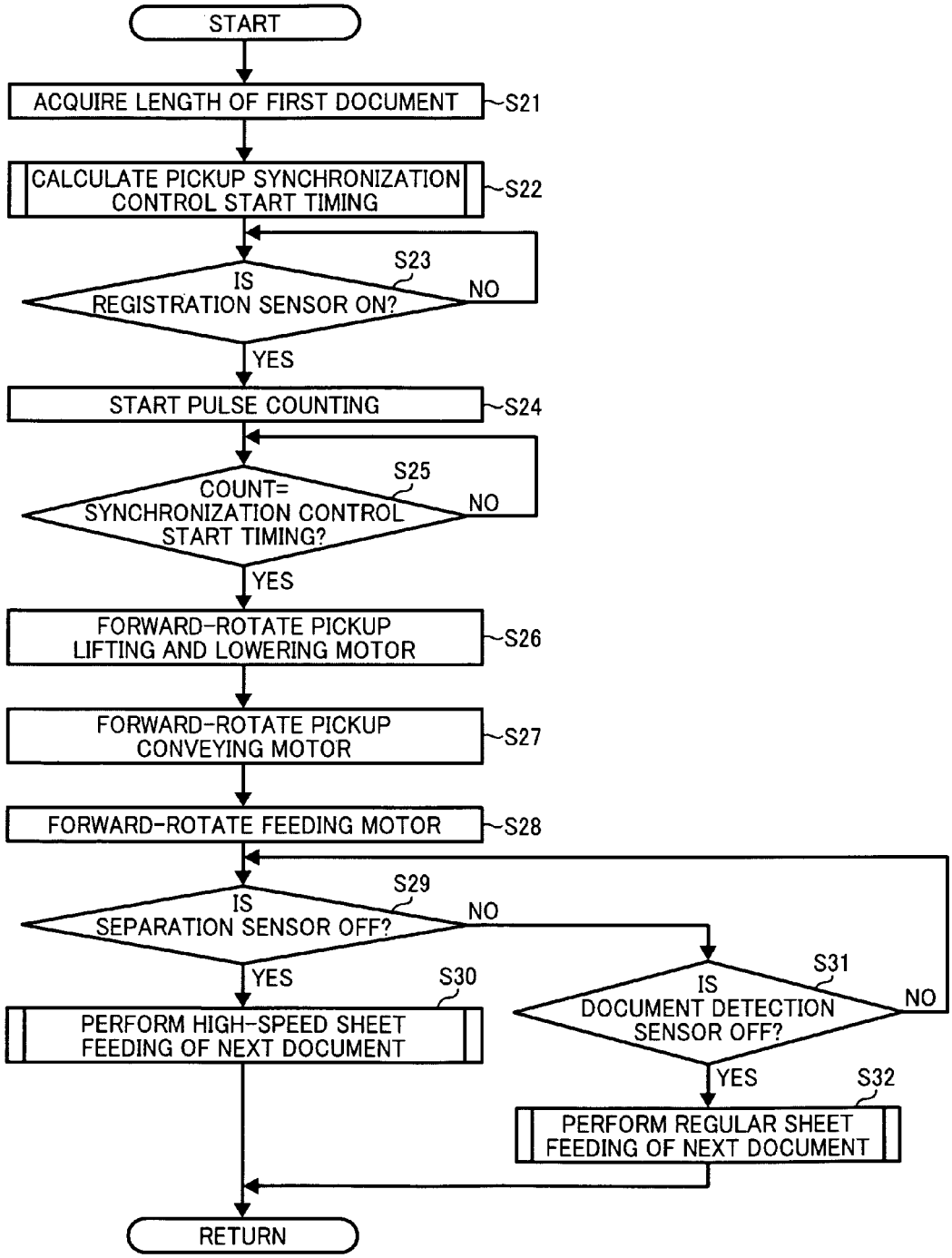
FIG. 7 is a diagram illustrating a control flowchart of regular sheet feeding according to an embodiment of the present patent application.

Referring to FIG. 7, a flowchart of detailed procedures of the regular sheet feeding is described.

The procedures of the regular sheet feeding illustrated in FIG. 7 are substantially same as the high-speed sheet feeding illustrated in FIG. 6, except that the regular sheet feeding does not include the high-speed conveyance control and the pre-separation control. That is, steps S21 to S26 in FIG. 7 correspond to steps S2 to S7 in FIG. 6. Further, step S27 in FIG. 7 corresponds to step S10 in FIG. 6, and step S28 in FIG. 7 corresponds to step S14 in FIG. 6. Further, steps S29 to S32 in FIG. 7 correspond to steps S15 to S18 in FIG. 6. Accordingly, detailed descriptions of procedures of the regular sheet feeding are omitted here.

As described above, the regular sheet feeding is performed when the next document P' is drawn together with the previous document P and thus the separation sensor SN1 fails to turn OFF. Further, whether the next document P' is to be subjected to the regular sheet feeding or the high-speed sheet feeding is determined in the sheet feeding of each document. Accordingly, the sheet feeding can be performed under optimal condition according to the state of each document.

The above-described embodiments are illustrative and do not limit the present patent application. Thus, numerous additional modifications and variations are possible in light of the above teachings. For example, elements or features of different illustrative and exemplary embodiments herein may be combined with each other or substituted for each other within the scope of this disclosure and appended claims. Further, particular features of components of the embodiments, such as their number, position, and shape, are not limited the embodiments described herein. It is therefore to be understood that, within the scope of the appended claims, the disclosure of this patent specification may be practiced otherwise than as specifically described herein.

What is claimed is:

1. A document feeding device, comprising:

a carrying unit capable of carrying thereon a plurality of documents;

a drawing device to draw and supply the carried documents;

a drawing device drive source to drive the drawing device;

a separation unit including a separation device to separate the supplied documents one by one;

a separation device drive source independent of the drawing device drive source and to drive the separation device;

a conveying device to convey the separated documents;

a reading unit including a reading device to read information of the conveyed documents;

a discharge device to discharge the read documents;

a first document detector provided between a document set position of the carrying unit and the separation unit to detect the documents;

a second document detector provided downstream of the separation unit and near a separation position of the separation unit to detect the documents, at least the first document detector detecting a trailing end of each of the documents in sheet feeding of the documents; and a controller to control operation of the drawing device based on detection results obtained by the first document detector and the second document detector, wherein the control of the operation of the drawing device is a pickup synchronization control which lowers a pickup roller of the drawing device by predicting the timing at which the trailing end of each of the second and subsequent documents passes the first document detector, based on a length of a first document, and wherein the pickup synchronization control is not performed when a mixed mode is set to read documents of different document lengths.

2. The document feeding device according to claim 1, wherein the control of the operation of the drawing device is a high-speed conveyance control which sets the document conveying speed of the drawing device to be higher than the document conveying speed of the separation device.

3. The document feeding device according to claim 2, wherein each of the second and subsequent documents is subjected to a pre-separation control which first drives the drawing device to rotate in a direction away from a reading position and then drives the drawing device to rotate in the opposite direction to convey the document toward the reading position.

4. The document feeding device according to claim 3, wherein the control to perform the high-speed conveyance and the pre-separation is determined on the basis of whether or not the first document detector has detected the trailing end of the document preceding each of the second and subsequent documents.

5. An image forming apparatus, comprising:

the document feeding device according to claim 1; and an image forming mechanism to form images of documents fed by the document feeding device.

6. A control method for a document feeding device, the document feeding device including:

a carrying unit capable of carrying thereon a plurality of documents;

a drawing device to draw and supply the carried documents;

a drawing device drive source to drive the drawing device;

a separation unit including a separation device to separate the supplied documents one by one;

a separation device drive source independent of the drawing device drive source and to drive the separation device;

a conveying device to convey the separated documents;

a reading unit including a reading device to read information of the conveyed documents;

a discharge device to discharge the read documents;

a first document detector provided between a document set position of the carrying unit and the separation unit to detect the documents;

a second document detector provided downstream of the separation unit and near a separation position of the separation unit to detect the documents; and a controller to control operation of the drawing device based on detection results obtained by the first document detector and the second document detector, the control method comprising:

detecting a trailing end of each of the documents in sheet feeding of the documents using the first document detector and the second document detector;

predicting the timing at which the trailing end of each of second and subsequent documents passes the first document detector; and lowering a pickup roller of the drawing device based on the length of a first document wherein the control of the operation of the drawing device is a pickup synchronization control, and wherein the pickup synchronization control is not performed when a mixed mode is set to read documents of different document lengths.

7. The control method according to claim 6, wherein the control of the operation of the drawing device is a high-speed conveyance control which sets the document conveying speed of the drawing device to be higher than the document conveying speed of the separation device.

8. The control method according to claim 7, wherein each of the second and subsequent documents is subjected to a pre-separation control which first drives the drawing device to rotate in a direction away from a reading position and then drives the drawing device to rotate in the opposite direction to convey the document toward the reading position.

9. The control method according to claim 8, wherein the control to perform the high-speed conveyance and the pre-separation is determined on the basis of whether or not the first document detector has detected the trailing end of the document preceding each of the second and subsequent documents.

10. A document feeding device, comprising:

a carrying unit capable of carrying thereon a plurality of documents;

a drawing device to draw and supply the carried documents;

a drawing device drive source to drive the drawing device;

a separation unit including a separation device to separate the supplied documents one by one;

a separation device drive source independent of the drawing device drive source and to drive the separation device;

a conveying device to convey the separated documents;

a reading unit including a reading device to read information of the conveyed documents;

a discharge device to discharge the read documents;

a first document detector provided between a document set position of the carrying unit and the separation unit to detect the documents;

a second document detector provided downstream of the separation unit and near a separation position of the separation unit to detect the documents, at least the first document detector detecting a trailing end of each of the documents in sheet feeding of the documents; and a controller to control operation of the drawing device based on detection results obtained by the first document detector and the second document detector, wherein the control of the operation of the drawing device is a high-speed conveyance control which sets the document conveying speed of the drawing device to be higher than the document conveying speed of the separation device, and wherein each of the second and subsequent documents is subjected to a pre-separation control which first drives the drawing device to rotate in a direction away from a reading position and then drives the drawing device to rotate in the opposite direction to convey the document toward the reading position.

11. The document feeding device according to claim 10, wherein the control to perform the high-speed conveyance and the pre-separation is determined on the basis of whether or not the first document detector has detected the trailing end of the document preceding each of the second and subsequent documents.

* * * * *